US006702458B2

(12) United States Patent
Sirand

(10) Patent No.: US 6,702,458 B2
(45) Date of Patent: Mar. 9, 2004

(54) DEVICE FOR INSTALLING A THERMOCOUPLE

(75) Inventor: Joseph Sirand, Laplume (FR)

(73) Assignee: Centre d'Etude et de Realisations D'Equipment et de Materiel (Cerem), Laplume (FR)

( * ) Notice: Subject to any disclaimer, the term of this patent is extended or adjusted under 35 U.S.C. 154(b) by 0 days.

(21) Appl. No.: 10/220,056

(22) PCT Filed: Mar. 28, 2001

(86) PCT No.: PCT/FR01/00938

§ 371 (c)(1),
(2), (4) Date: Aug. 28, 2002

(87) PCT Pub. No.: WO01/75367

PCT Pub. Date: Oct. 11, 2001

(65) Prior Publication Data

US 2003/0029491 A1 Feb. 13, 2003

(30) Foreign Application Priority Data

Mar. 30, 2000 (FR) ..... 00 04002
Jul. 11, 2000 (FR) ..... 00 09014

(51) Int. Cl.[7] ..... H01L 35/00; H01L 37/00; G01K 1/14; G01K 7/00

(52) U.S. Cl. ..... 374/208; 374/141; 374/179; 136/200

(58) Field of Search ..... 374/141, 163, 374/179, 208, 200; 136/200, 219

(56) References Cited

U.S. PATENT DOCUMENTS 2,710,055 A 6/1955 Betz
3,680,382 A * 8/1972 Vaiden
4,510,343 A * 4/1985 Sivyer
4,697,453 A * 10/1987 Murakawa et al.
4,834,550 A * 5/1989 Yano et al.
4,914,948 A * 4/1990 Murakawa et al.
5,005,986 A * 4/1991 Najjar et al.
5,139,345 A * 8/1992 Schafer et al.
5,197,805 A * 3/1993 Wilson
5,662,418 A * 9/1997 Deak et al.
5,711,608 A * 1/1998 Finney
6,053,632 A * 4/2000 Leininger
6,059,453 A * 5/2000 Kempf et al.

FOREIGN PATENT DOCUMENTS

| | | |
|---|---|---|
| EP | 63049622 | 3/1988 |
| EP | 06214219 | 8/1994 |
| GB | 1 442 745 | 7/1976 |
| GB | 1 536 520 | 12/1978 |

* cited by examiner

*Primary Examiner*—Gail Verbitsky
(74) *Attorney, Agent, or Firm*—Young & Thompson

(57) ABSTRACT

Device for the installation in an air-gas feeding duct, a standard thermocouple to provide both a cold safety function in case of extinction, and a hot safety function, without any additional device, in case of internal combustion. The downstream portion of the bulb side (4) of the thermocouple penetrates into the air-gas duct (2). Its probe tip (3) is immobilized against the inner surface of the diffusion chamber (5) at the center of the combustion chamber (6). Its connector (16) is secured to its exit point from the duct (2) at a marker-projection (17) by a lock (15). The life span of the thermocouple is considerably increased through permanent cooling by the fresh air-gas mixture of the elements proximate to combustion. In case of internal combustion, the inversion of temperature gradients of the cold and hot junctions of the thermocouple causes the generated electromotive force to fall rapidly. The device is designed for high temperature confinement burners.

9 Claims, 4 Drawing Sheets

DEVICE FOR INSTALLING A THERMOCOUPLE

BACKGROUND OF THE INVENTION

The invention relates to the means of installing a conventional thermocouple in the interior of the air-gas supply duct of a gas burner, in order for it to provide, at one and the same time:

a) the function of "cold safety" in the case of flame extinction, b) the function of "hot safety" in the case of the injector catching fire, and this without any additional device, c) a considerably increased operational service-life, thanks to the permanent cooling, by the "cool" air-gas mixture, of this thermocouple which is very highly heated at the level of its elements close to the combustion chamber.

The device is particularly intended for apparatuses, the combustion chamber of which operates in a confined space at high temperatures and nevertheless requires the thermocouple to be positioned at the level of said chamber.

DESCRIPTION OF THE RELATED ART

In the present state of the art, thermocouples are component parts of a well-known safety device, the external appearance of which is in the form of a metal sheath, called an external conductor, which terminates, on the side exposed to the heat, in a sensing point in a bulb which forms a sleeve subject to a casing and, at the other end, in an electrical connection to a safety valve.

Inside the bulb sleeve, a segment formed from a specific metal which differs from that of the sleeve of the bulb is welded at its end to the point of the latter. This weld is called a "hot weld". This segment is extended, at its other end, by another weld to an insulated conductor wire enclosed in the external conductor tube. This second weld is called a "cold weld". Finally, the internal conductor wire is connected to the outlet of the conductor tube, the connection to the safety valve. Internal conductor and external conductor are thus connected to an electromagnetic coil inside a safety valve. When the sensor point of the bulb is subjected to the heat of a burner, the temperature difference which is established between the hot weld and the cold weld generates a movement of the electrons, and the difference in potential created engenders a continuous micro-current, the electromotive force of which is capable of inducing, at the level of the solenoid of the coil of the safety valve, an electromagnetic field sufficient to maintain, in the attracted position against the electromagnet of said coil, a displaceable core which carries the opening-closing flap of the safety valve. If the sensor point of the thermocouple cools when the production of heat by the burner ceases when it is extinguished, intentionally or not, the difference in potential disappears, and therefore also the electromagnetic field, and the flap, withdrawn by a spring, returns into a closed position. In the present state of the art, this safety device by thermocouple is entirely satisfactory in numerous applications where the configuration of the combustion apparatuses of the gas permits the thermocouple to be positioned so that only the hot weld of the sensor point is exposed to the heat of a flame. This is principally the case in devices with pilot lights or combustion igniters not confined in an environment of excessive temperature. And if the temperature, solely at the sensor point, does not exceed 600° C., the service-life of the thermocouple remains within the limits of a normal service-life and does not pose any special problems other than reasonable maintenance when the wear on the sensor point exposed to the oxidising combustion of a naked flame finally destroys the hot weld, thereby preventing the generation of the desired electromotive force.

The situation is not as satisfactory, or even acceptable, in other applications, and in particular new applications, where it is not possible to limit the exposure to heat of the only sensor point of the thermocouple and to contain, moreover, this exposure to heat within a temperature gradient which does not exceed 600° C. at the maximum. This is the case, by way of a non-limiting example, with the new combustion chambers of "high temperature" infrared radiators with metal refractory grilles where the desired configuration necessitates the introduction of the sensor point into a confined combustion chamber to attain temperatures reaching more or less 950° C.

In these conditions, not only is the sensor point of the bulb subjected to a temperature exceeding its own limits of 600° C. for its service-life, but also the casing to which this bulb is secured is subjected to an unacceptable temperature by conduction. It is inside and at the level of this casing that the "cold" weld is situated. This cold weld, raised to too high a temperature, affects the value of the difference in potential with the "hot" weld but, above all, subjects the segment between these 2 welds, which is formed from a specific alloy, to inexorable destruction by material loss according to a geometry of "pencil points" opposed by the summit (in the image of electric arc electrodes), this deterioration continuing until there is a definitive break in the segment at the level of the 2 opposite points.

To this is immediately added, upstream of the casing, the attack on the external conductor which becomes porous and particularly sensitive to oxidation and to the corrosive action of the burnt gases released by the neighbouring combustion.

In these temperature and proximity conditions, the service-life of a conventional thermocouple is reduced very substantially. The efforts used to extend this service-life consist substantially of retarding these destructive effects:

d) reinforcing the volume of the hot weld, e) treating the surface with a deposit of nickel on the casing and on the portion of the external conductor close to the hot area.

No matter what is done, it must be admitted that these efforts for improvement only relate to the effects and not to the cause.

With reference to hot safety devices, in case of the injector catching fire, known electrical cut-off devices follow the "mechanical" concept, in that this break occurs by a fuse blowing or by opening a thermostatic contact. These devices obviously lead to extra cost with, moreover, the disadvantage of a "pirate" shunt always possible by an unaware or careless user.

SUMMARY OF THE INVENTION

Therefore, the object of the present invention is:

for cold safety:

f) to treat the cause of the precocious deterioration of thermocouples when these are placed, of necessity, in the very centre of combustion chambers which are raised to a high temperature, reaching more or less 950° C.;

for hot safety:

g) to take advantage of the consequences induced by the installation means used in order to treat this cause of deterioration, also to permit the thermocouple to provide the function of hot safety without a "mechanical" electrical cut-off device.

And hence to obtain, overall, with a conventional thermocouple, long use at minimum cost, since it is used to provide, at one and the same time, cold and hot safety functions on apparatuses having a confined combustion chamber which have the advantage of generating high temperatures. These high temperatures are particularly desirable for infrared light emitters in order to obtain electromagnetic wavelengths of between 1.5 and 4 micrometers.

More precisely, the invention comprises a device for installing a thermocouple in the interior of the air-gas duct of a gas burner so as to ensure the functions both of cold safety and of hot safety, said thermocouple comprising an external conductor, which terminates in a sensor point in a bulb forming a sleeve subject to a casing, characterised in that the downstream portion of the external conductor of the thermocouple, on the sensor point side, penetrates to the interior of the inlet duct for the air-gas mixture, in that the sensor point at the end of the bulb is supported on the internal surface of the contact zone of the perforated wall of a diffusion chamber, and in that the installation device comprises a small plate secured transversely to the outlet section of the air-gas duct, said small plate having an appropriately dimensioned surface, to fulfil the function of a localised retardant screen for the air-gas flow, at the level of the contact zone with the internal surface of the diffusion chamber, the base of the casing for supporting the bulb also being supported in the gap of the small guiding and positioning plate, the small plate being subject either to the outlet of the air-gas duct or to the base of the diffusion chamber on the outlet side of the duct.

It is appropriate to demonstrate the operating principle of the present invention by a general presentation. Therefore, the device which is the subject-matter of the present installations and combinations consists of:

h) positioning the thermocouple by causing it to be placed inside the inlet duct of the air-gas mixture, to cause the sensor point to emerge, at the end of the bulb inside the diffusion chamber at the centre of the combustion chamber or, if there is no diffusion chamber, at the outlet of the supply duct in the combustion chamber itself, according to the installation details which will be described later in an additional example, with reference to FIG. 3, i) guiding the bulb 4 of the sensitive element (sensor point) of the thermocouple introduced into the air-gas mixture supply duct and ensuring its exact positioning, the sensor point coming into abutment against the internal wall of the grille which constitutes the diffusion chamber, j) creating, by a deflector at the outlet of the tube on the diffusion chamber side, a mini-zone sheltered from the cool and rapid flow of the air-gas mixture not yet ignited.

This mini-zone, which is calmer, compels a small fragment of the grille wall of the diffusion chamber to become red very locally. On the other side of the grille, in fact, the air-gas mixture combusts at the level of the grille in the sheltered mini-zone. It is precisely at this very spot that the sensor point abuts against the reddened grille or only there that the hot weld end is drawn by the necessary and sufficient heat to generate the desired electromotive force and therefore to provide the function of "cold" safety, thanks to the sheltered mini-zone. The temperature ranges, at the sensor point, are confined to around 500° C. Upstream of the sensor point and of the bulb, all of the rest of the thermocouple, being in fact ventilated by the cool air-gas flow, sees its temperature settled at a very much lower level than that of the hot weld, this difference reaching several hundreds of degrees centigrade.

Moreover, this ventilation by the new and cool flow shelters it from any contact with the ambient gases of the neighbouring combustion, gases which are even more corrosive when they are extremely hot, and, as a consequence, very damaging for the thermocouple in respect of its service-life. To fulfil the function of hot safety, without an additional mechanical device, in the case of the injector catching fire, it is the heat of this internal combustion itself, in the air-gas duct before its outlet into the diffusion chamber, that is used. This internal ignition then encompasses the external conductor of the thermocouple which runs through the interior of the duct as far as the casing where the cold weld is situated. Since the combustion zone is thus displaced from the burner in the duct, the cold weld heats up while the hot weld cools down. The electromotive force is reduced, and the gas shut-off safety operation is automatic. With the means put into effect according to the invention, this inversion of temperatures is exactly the consequence, for an internal thermocouple, of the injector catching fire. In this eventuality, in fact, since the air-gas mixture ignites in the duct and no longer in the combustion chamber, the casing containing the cold weld becomes hotter than the bulb assembly and the sensor point which contain the hot weld. In a time lapse in the order of 15 to 45 seconds, depending on the features of the component parts used, the electrical cut-off interrupts the firing. The brevity of this abnormal event does not affect the external conductor sufficiently to cause it to deteriorate seriously, and experiments show that about ten accidents of the injector catching fire in succession, and therefore nine maintenance operations of an apparatus to be missed, would be needed to have to replace the thermocouple.

BRIEF DESCRIPTION OF THE DRAWINGS

For the convenience of the description, it is appropriate to describe, depending on the preferred embodiment, the most current cases where the invention may be used to advantage. This is particularly the case with infrared radiation gas burners at high temperature, according to the technology of combustion in a confined chamber. This does not exclude other types of burners for other applications, as will be mentioned later.

DESCRIPTION OF THE PREFERRED EMBODIMENTS

Figure 1:
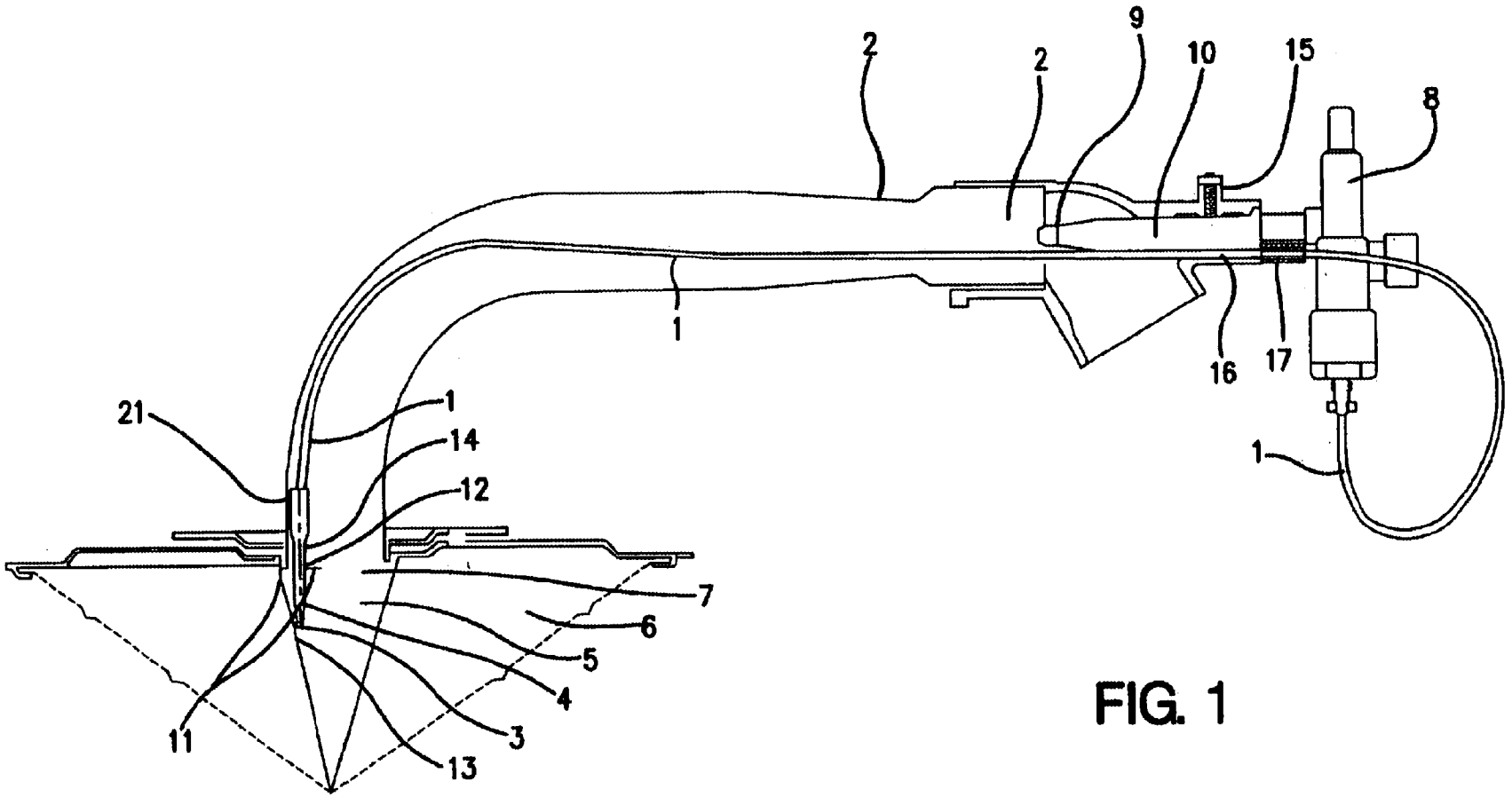
FIG. 1 is a longitudinal sectional view through a first embodiment of a thermocouple arrangement according to the invention, in a burner with a bent air-gas inlet duct.

In the case of FIG. 1, the portion relating to the burner, the subject-matter of the description, substantially comprises:

k) on the upstream side, an inlet duct for an air-gas mixture, also called a Venturi tube 2. At its inlet end, this Venturi tube comprises:

l) a new air plug;

m) a gas inlet safety valve 8, which supplies a gas injector 9 secured to the end of an injector-carrying tube 10. This assembly is of conventional type.

n) on the downstream side, at its air-gas mixture outlet end, the Venturi tube 2, bent in the example described, comprises a small guiding and positioning plate 11 for the sensor point 3, at the end of the bulb 4 of the thermocouple before its outlet 7 into the diffusion chamber 5. A gap 12, in which the bulb 4 of the thermocouple is engaged, is provided on this small positioning plate 11. Having traversed this small plate, the sensor point 3 abuts against the internal surface 13 of the grille which forms the wall of the diffusion chamber 5. This solution for securing the small plate to the base of the air-gas mixture inlet tube is a convenient solution in the present example.

However, this solution is not exclusive, and it may be advantageous, in other configurations, to secure the small plate, not to the tube but at the level of the diffusion chamber itself, where its base comes into contact with the tube.

It is essential that the function of guiding, positioning the bulb and contact with the grille of the diffusion chamber is ensured by whatever equivalent means.

The small guiding and positioning plate is orientated through the longitudinal movement of the air-gas flow, so that its surface forms, as a deflector, a screen to the velocity of the flow at the outlet of the Venturi tube. Thus, a calmer flow mini-zone is created between the non-exposed face of the small plate 11 and the internal surface portion 13 of the wall of the diffusion chamber, because it is sheltered under the small plate. This calmer flow, when it burns on the external surface of the grille of the diffusion chamber at the level of the mini-zone, burns at the level of the grille, which then has a small surface of localised reddening of the metal of the grille, precisely around the contact point of the sensor point with the grille. The desired object is to heat only the end of the hot weld of the sensor point without affecting the rest of the thermocouple by the harmful effects of too high a temperature. The interposition of a grille between the sensor point (hot weld) and the combustion flame has, amongst others, the advantage of protecting this point from deterioration encouraged by the oxidising nature of a naked flame. Experiments show the importance of this factor on the reduction in service-life of the sensor points of the thermocouples.

To complete the description of the precise guiding means of the thermocouple, after its introduction through the upstream of the Venturi tube to position the sensor point at the centre of the gap 12 of the small guiding and positioning plate, it should be noted that the tubular cross-section, concave on the inside, of the welded portion of the tube (convex on the outside) is particularly helpful in guiding the sensor point automatically. Like the Talweg line of a channel, there is only one line of greater incline, and a single line, at the base of the concavity of the tube, according to which the sensor point will necessarily slide towards the centre of the gap of the small positioning plate, placed vertically from this sliding line.

Figure 2:
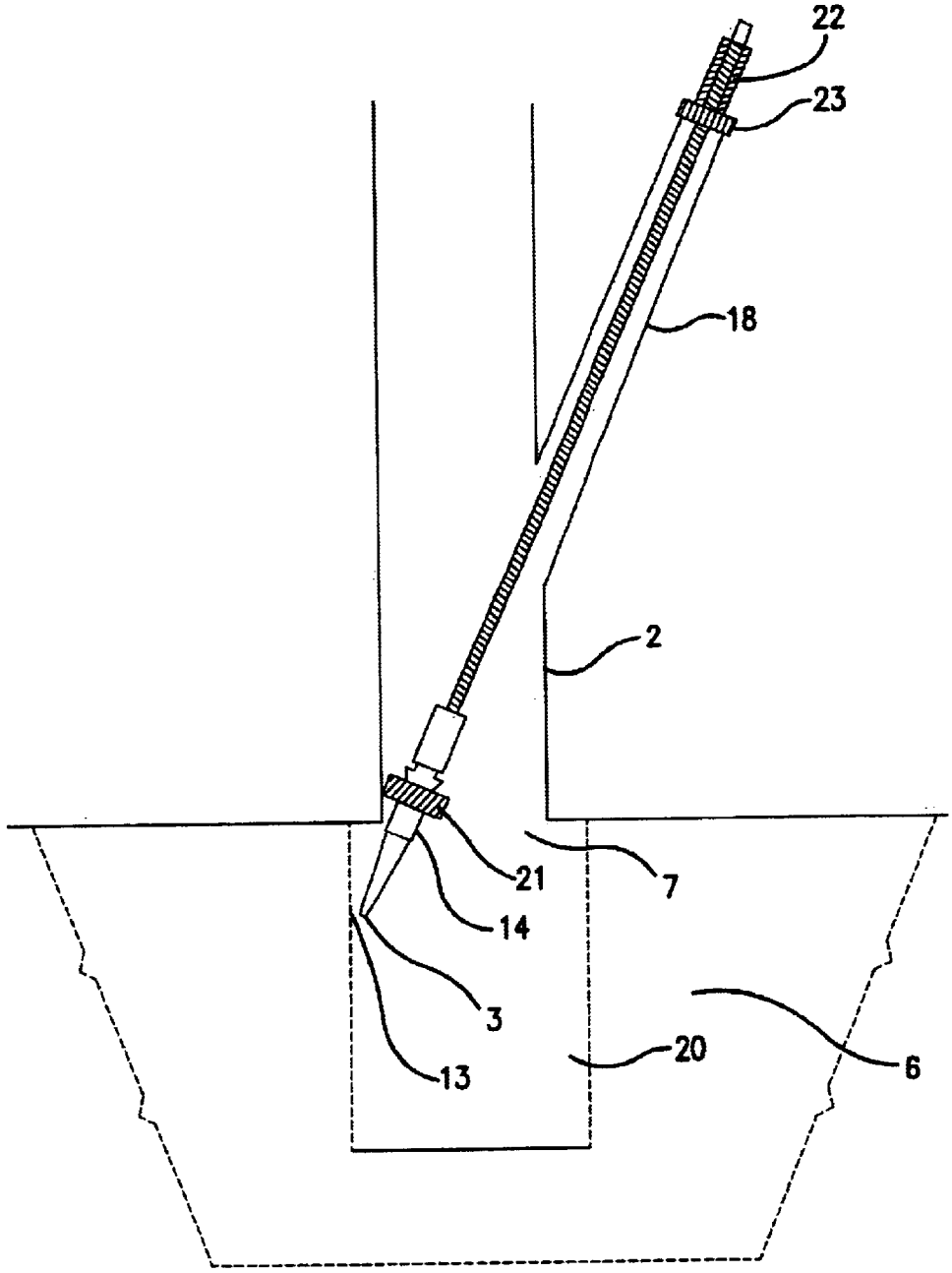
FIG. 2 is a longitudinal sectional view through a second embodiment of a thermocouple arrangement according to the invention, in a burner with a non-bent air-gas inlet duct.

In the case of other apparatus configurations, more especially burners which comprise a non-bent Venturi tube 2, whether it is vertical or oblique, FIG. 2 illustrates how the introductory and positional guiding of the thermocouple through an adjacent sleeve 18 may be ensured as rigorously, by means of the "channel" effect of the interior of the tube, immediately upstream of its outlet into the diffusion chamber.

It is then necessary to block, as illustrated in FIG. 2, the free end of the adjacent sleeve around the external conductor of the thermocouple, both to avoid disturbing the air-gas flow and to prevent any untimely return of flow through the sleeve.

Figure 4:
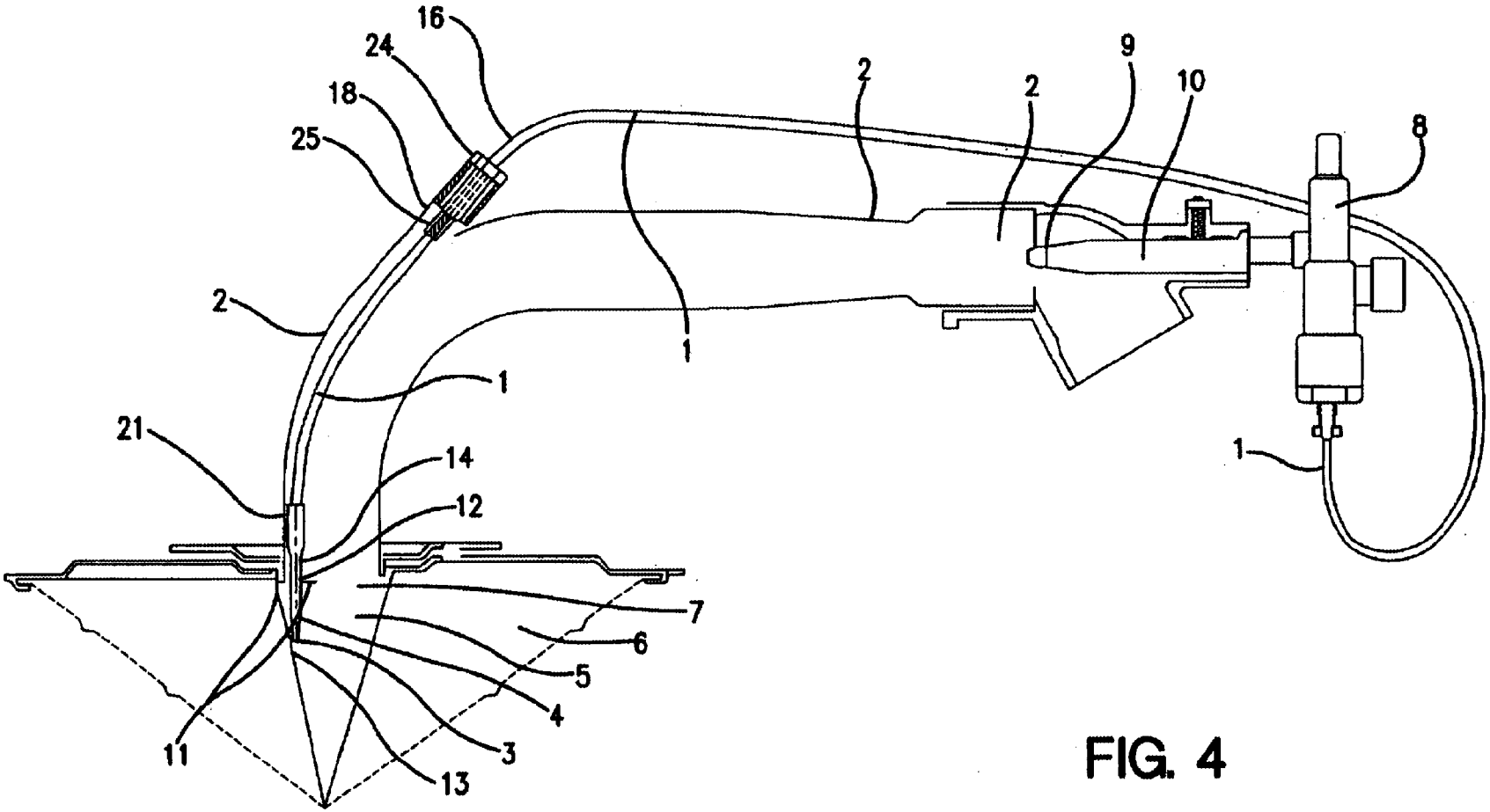
FIG. 4 is a longitudinal sectional view through a fourth embodiment of a thermocouple arrangement according to the invention, in a burner with a bent air-gas inlet duct.

It may also prove interesting to use an adjacent guide sleeve 18 for introductory and positional guiding on an apparatus which comprises a bent Venturi tube. FIG. 4 illustrates this possibility, the adjacent sleeve 18 being connected to the tube 2 at the most appropriate point on said tube, it being essential:

o) to retain the "channel" effect inside the tube, such as is described above, p) to permit the downstream portion of the external conductor of the thermocouple, introduced by the sleeve inside the tube and therefore situated above the casing 14 of the thermocouple, to benefit from the ventilation of the fresh air-gas flow moving towards the outlet 7 over a sufficient length for it to be cooled.

It is to be noted that, if the adjacent sleeve 18 cannot be positioned, for any reason, in the longitudinal plane of symmetry of the bent tube, but is offset laterally according to an oblique plane relative to the longitudinal plane, the line of greatest slope which forms a "channel" is situated in this oblique plane. As a consequence, the small plate 11 and its guiding gap 12 for the bulb 4 of the thermocouple must be disposed in this oblique plane, since this plane contains the base "channel" line.

Moreover, in the configuration illustrated in FIG. 4 and as in the case of the non-bent tube of the configuration illustrated in FIG. 2, it is necessary to block the free end of the adjacent sleeve 18 around the external conductor of the thermocouple by a locking and stopping element: beyond this free end of the sleeve, the external conductor of the thermocouple is situated outside the air-gas duct and connects with the safety valve 8, to which it is attached in conventional manner.

The "combustion" portion of the burner referred to in the description with FIG. 1 finally comprises a combustion chamber 6, the volume of which is defined:

q) by the external face of the wall of the diffusion chamber mentioned above, and r) by the internal face of the external chamber ofsaid combustion chamber. It is in this space, between these two walls, that the igniting and combustion of the air-gas mixture occurs at high temperature, this temperature possibly reaching more or less 950° C. It will be noted, therefore, that the thermocouple itself is well situated, entirely separated from this space where the combustion takes place, since even its sensor point 3 is on the other side of the diffusion chamber.

Figures 3A, 3B:
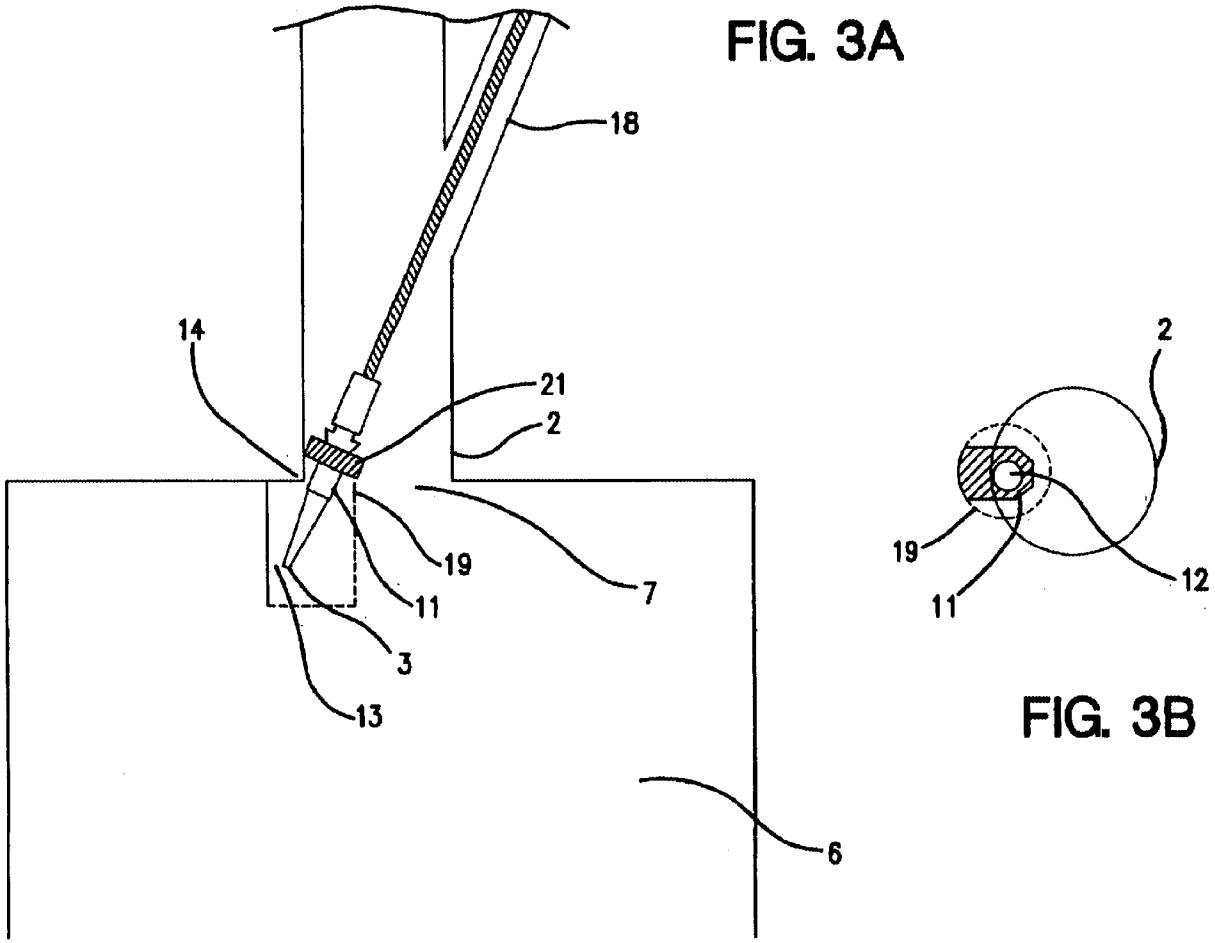
FIG. 3 is a longitudinal sectional view through a third embodiment of a thermocouple arrangement according to the invention, in a burner with a flat grille, called a "flame-catcher", at the level of the outlet of the tube.

To extend the application according to the invention to other burners, as illustrated in FIG. 3, not normally comprising a conical, cylindrical or other shaped diffusion chamber but only, and at best, a flat grille called a "flame-catcher", at the level of the outlet 7 of the tube 2, it is necessary to provide, at this level, a calm and protected space in accordance with the same principle as that described previously. This space is, in effect, a diffusion mini-chamber 19, formed from finely perforated refractory metal with, at its inlet on the tube side, a small plate 11 with a gap 12 for introducing the sensor point and the bulb. This small plate must have less surface area than the cross-section of the diffusion mini-chamber to allow the fresh (hence non-ignited) flow of the air-gas mixture to fill the interior volume of said mini-chamber through this inlet. Thus, the conditions for protecting the sensitive end of the thermocouple are reproduced, in the same way as the desired ventilation for the casing and the external conductor of the thermocouple.

Therefore, including in these other configurations, a thermocouple of conventional form may be used and fitted as follows:

a) sensor point side at the bottom of the bulb:
   - the casing 14 for securing the bulb 4 is used over its first millimeters joining the bulb as a support bearing in the gap 12 of the small guiding and positioning plate 11;
   - the sensor point, at the level of its hot weld 3, encounters the internal wall of the diffusion chamber as an abutment and support point;
   - in the present description of the preferred configuration according to FIG. 2, as in the configuration illustrated in FIG. 4, the bulb-casing assembly of the thermocouple is wedged, naturally, by the "corner" effect, between these two support points, this wedging being encouraged by the obliqueness of the conical wall of the diffusion chamber 5;
   - in other configurations such as, for example, that of a cylindrical diffusion chamber 20, the "corner" effect of the bulb-casing assembly against the grille of the diffusion chamber is advantageously achieved, for example, by a cylindro-conical protuberance 21 on the casing 14, vertically upstream of the small guiding and positioning plate. This protuberance 21, which may be a collar force-threaded onto the casing, supported on the internal wall of the Venturi tube, imparts to the bulb-casing assembly the obliqueness which could be lacking therefrom by reason of the verticality of the cylindrical wall of the diffusion chamber.

b) Inlet side of the Venturi tube:
   - it is necessary to immobilise the external conductor of the thermocouple in order to prevent its recoil and to guarantee thereby the permanence of the abutment contact of the sensor point against the internal wall 13 of the diffusion chamber; this precise securement of the external conductor relative to the Venturi tube is ensured by two appropriate means in the case of the configuration described:
     - -on the Venturi tube:
       - a tightening screw 15 at the level of the air inlet locks the external conductor 16 of the thermocouple in the suitable position by pressing it against the gas injector tube 10,
     - -on the external conductor:
       - a marker-projection 17, forming a stop-member, prevents the conductor from penetrating more deeply into the tube. It also serves as a positioning marker if, on the contrary, this penetration is insufficient. An interesting means of effecting this marker-projection 17 comprises using a segment of heat-retractable sheathing which has the advantage of being easily inserted into the thermocouple prior to retractable heating and being rigorously positioned after this heating. It goes without saying that any other means which produce an equivalent result may be used, more especially in the case of other configurations, it being essential that the internal thermocouple is systematically retained in the suitable securement position.

Among these other means of securement and reference may be mentioned those illustrated by 22 and 23 in FIG. 2, which also ensure that the free end of the adjacent sleeve 18 is blocked, as well as the one illustrated by 24 and 25 in FIG. 4. The marker 25 is then a projection member secured on the external conductor of the thermocouple, downstream of the tightening and blocking means 24, and therefore inside the sleeve 18. The blocking of the external conductor of the thermocouple and the positioning of the sensor point 3 is ensured when the screw 24, through which the external conductor of the thermocouple passes, is fully screwed-in.

In short, by the detailed description above, the device and the means of fitting described permit a conventional thermocouple to be used, by installing its downstream portion, on the sensor point side, inside the inlet duct of the air-gas mixture on the burner. Its upstream portion then emerges outside, either through the air-gas inlet end of the bent Venturi tube or through an adjacent sleeve connecting with said tube, whether it is straight or bent, upstream of its outlet inside the diffusion chamber.

The functions of cold safety and of hot safety, in "high temperature" burners, are thereby ensured at one and the same time, after connecting the thermocouple to the safety valve:

- by doing away with the temperature limit above which the material resistance of the thermocouple is no longer ensured;
- by using, in the case of internal combustion in the inlet duct of the air-gas mixture, the temperature inversion between the hot weld and the cold weld of the thermocouple by reason of its overheating inside the duct where the air-gas mixture combusted. The result is the rapid interruption of this catching-fire at the injector by the collapse of the electromotive force, the final consequence of which is to shut-off the gas inlet at the safety valve.

What is claimed is:

1. Device for installing a thermocouple (1) in an interior of an air-gas inlet duct (2) of a gas burner so as to ensure the functions both of cold safety and of hot safety, said thermocouple comprising an external conductor, which terminates in a sensor point in a bulb forming a sleeve being a casing, characterised in that a downstream portion of the external conductor of the thermocouple, on a sensor point (3) side, penetrates to the interior of the inlet duct (2) for the air-gas mixture, in that the sensor point (3) at the end of the bulb (4) is supported on an internal surface of a contact zone (13) of a perforated wall of diffusion chamber (5, 19), and in that the device for installing comprises a small plate (11) secured transversely to an outlet section (7) of the air-gas inlet duct (2), said small plate having an appropriately dimensioned surface, to fulfill the function of a localized retardant screen for an air-gas flow, at a level of the contact zone (13) with an internal surface of the diffusion chamber (5, 19), a base of the casing (14) for supporting the bulb (4) also being supported in a gap (12) of the small guiding and positioning plate (11), the small plate (11) either belongs to the outlet of the air-gas duct (2) or to the base of the diffusion chamber on an outlet (7) side of the duct.

2. Device according to claim 1, characterised in that the casing for supporting the bulb is provided with a protuberance (21), a profile of which determines the inclination and wedging of the sensor point (3) against the contact zone (13) of an internal surface of the wall of the diffusion chamber (5).

3. Device according to claim 1, characterised in that, the body of the burner is aligned about a vertical axis, with an air-gas duct (2) which is substantially vertical on the outlet (7) side, the downstream portion of the thermocouple, on the sensor point (3) side, penetrates into the interior of the air-gas duct (2) upstream of the outlet through an adjacent guide sleeve (18) which connects with said duct (2), the external conductor of the thermocouple then being integral, at a level of the marker-projection (22), with a free end of an adjacent sleeve through a locking and sealing element (23).

4. Device according to claim 1, characterised in that, a body of the burner comprises a bent air-gas duct, the downstream portion of the thermocouple, on the sensor point (3) side, penetrates into the interior of said air-gas duct (2) through an upstream end of a Venturi tube (2) on the air-gas mixture inlet side, the external conductor (16) of the thermocouple (1) then being integral, at a level of its marker-projection (15), through a locking means (17).

5. Device according to claim 1, wherein the air-gas duct is bent, and wherein the downstream portion of the thermocouple, on the sensor point side, penetrates into the interior of the air-gas duct, either through the end of this duct on the air-gas inlet side, or through an adjacent sleeve connecting with said duct, the upstream portion of the external conductor of the thermocouple, which comprises, at its end, a connection to a safety valve (8), being situated on the outside of the duct on the air-gas inlet side.

6. Device according to claim 1, further comprising a flame attachment grille, wherein the diffusion chamber (19) and the small guiding and positioning plate (11) are integrated, at a level of the outlet (7) of the air-gas mixture duct (2), with an inlet of the combustion chamber (6).

7. Device according to claim 2, characterised in that, the body of the burner is aligned about a vertical axis, with an air-gas duct (2) which is substantially vertical on the outlet (7) side, the downstream portion of the thermocouple, on the sensor point (3) side, penetrates into the interior of the air-gas duct (2) upstream of the outlet through an adjacent guide sleeve (18) which connects with said duct (2), the external conductor of the thermocouple then being integral, at a level of the marker-projection (22), with a free end of an adjacent sleeve through a locking and sealing element (23).

8. Device according to claim 2, characterised in that, a body of the burner comprises a bent air-gas duct, the downstream portion of the thermocouple, on the sensor point (3) side, penetrates into the interior of said air-gas duct (2) through an upstream end of a Venturi tube (2) on the air-gas mixture inlet side, the external conductor (16) of the thermocouple (1) then being integral, at a level of its marker-projection (15), through a locking means (17).

9. Method according to claim 2, further comprising a bent air-gas duct, and wherein the downstream portion of the thermocouple, on the sensor point side, penetrates into the interior of the air-gas duct, either through the end of this duct on the air-gas inlet side, or through an adjacent sleeve connecting with said duct, the upstream portion of the external conductor of the thermocouple, which comprises, at its end, a connection to a safety valve (8), being situated on the outside of the duct on the air-gas inlet side.

* * * * *